United States Patent [19]

Aston

[11] Patent Number: 5,036,982

[45] Date of Patent: Aug. 6, 1991

[54] RELATING TO PACKAGING CONTAINERS

[75] Inventor: Stephen Aston, Lincoln, England

[73] Assignee: Premier Brands U.K. Limited, Birmingham, England

[21] Appl. No.: 491,468

[22] Filed: Mar. 8, 1990

[30] Foreign Application Priority Data

Mar. 21, 1989 [GB] United Kingdom ..... 8906466

[51] Int. Cl.[5] ..... B65D 5/54

[52] U.S. Cl. ..... 206/611; 206/624; 206/628; 229/160.1

[58] Field of Search ..... 206/607, 611, 614, 615, 206/624, 268, 273; 229/160.1; 220/416

[56] References Cited

U.S. PATENT DOCUMENTS

| | | | |
|---|---|---|---|
| 2,361,659 | 10/1944 | Smith | 206/624 |
| 2,672,273 | 3/1954 | Smith | 206/624 |
| 2,906,444 | 9/1959 | Weiss et al. | 229/160.1 |
| 2,951,627 | 9/1960 | Wenzel | 220/416 |
| 2,998,910 | 9/1961 | Gillam | 206/268 |
| 3,050,233 | 8/1962 | Burgess | 206/624 |
| 3,680,766 | 8/1972 | Collura et al. | 206/615 |
| 3,708,108 | 1/1973 | Rosenberg, Jr. | 206/624 |
| 4,913,292 | 4/1990 | Field | 206/611 |

FOREIGN PATENT DOCUMENTS

| | | | |
|---|---|---|---|
| 89792 | 7/1967 | France | 206/607 |

*Primary Examiner*—Gary E. Elkins

*Attorney, Agent, or Firm*—Klauber & Jackson

[57] ABSTRACT

The invention provides a packaging container which is formed from a blank of cut and creased sheet material. The container is rectilinear in nature and is sealed. It has a flip top lid which is opened by engaging a tear tab with the finger and by removing a tear strip to release the flip top lid to gain access to the contents.

6 Claims, 2 Drawing Sheets

RELATING TO PACKAGING CONTAINERS

This invention relates to a packaging container, and in particular concerns an improved packaging container for holding tea bags or the like. Although the principle use of the container will in fact be for holding tea bags which are held in foil wrappings, the invention is not to be considered as limited to any specific contents for the container.

The container is formed from cut and creased sheet material such as cardboard or plastics sheet material, and in accordance with the invention the sheet material is cut and creased to form a blank which can be folded into a rectilinear container having a flip top lid which is initially opened by tearing the container along predetermined lines of weakening so that the lid can be hinged relative to the remainder of the container, to gain access to the contents, and wherein part of the blank forms an inner lining.

The said inner lining preferably comprises three panel sections which lie respectively on the inner surfaces of three walls of an outer case of the container. The outer case preferably comprises a front wall and rear wall and two side walls, a base and a top, the top and sections of the front, rear and side walls defining the lid, and wherein there is a tear strip section in the front wall providing a finger grip to enable a section to be removed by tearing to facilitate the opening of the lid relative to the remainder of the container.

The base is preferably defined by fold over flaps which are glued together in the erection of the container. The said top is preferably also defined by a fold over flap.

The erection of the blank into the container comprises the folding of the inner panels and outer panels and the gluing of same together to form a lay flat sleeve which is moved to erected condition, following which the base is formed by folding and gluing the base flaps, after which the container contents are inserted and finally the top is closed by folding and gluing of the top flaps. The container in effect is therefore "sealed" in that to open the container requires tearing of said tear strip and hinging back of the flip top lid.

The container contents in the preferred case comprise tea bags held in one or more hermetically sealed sleeves typically of flexible metalised plastic film sheet material.

The container may be for holding two of said sealed sleeves of tea bags side by side.

Although the invention is primarily concerned with the container construction as referred to herein, another aspect of this invention resides in the combination of a container constructed from cut and crease material and containing a quantity of tea bags held in one or more hermetically sealed wrappings, which typically may be of the construction and form described in our co-pending patent application Ser. No. 8914372.1. In this aspect of the invention, the outer container can take any suitable construction and need not be of the flip top form as described herein.

An embodiment of the invention will now be described, by way of example, with reference to the accompanying diagrammatic drawings, wherein.

Figure 1:
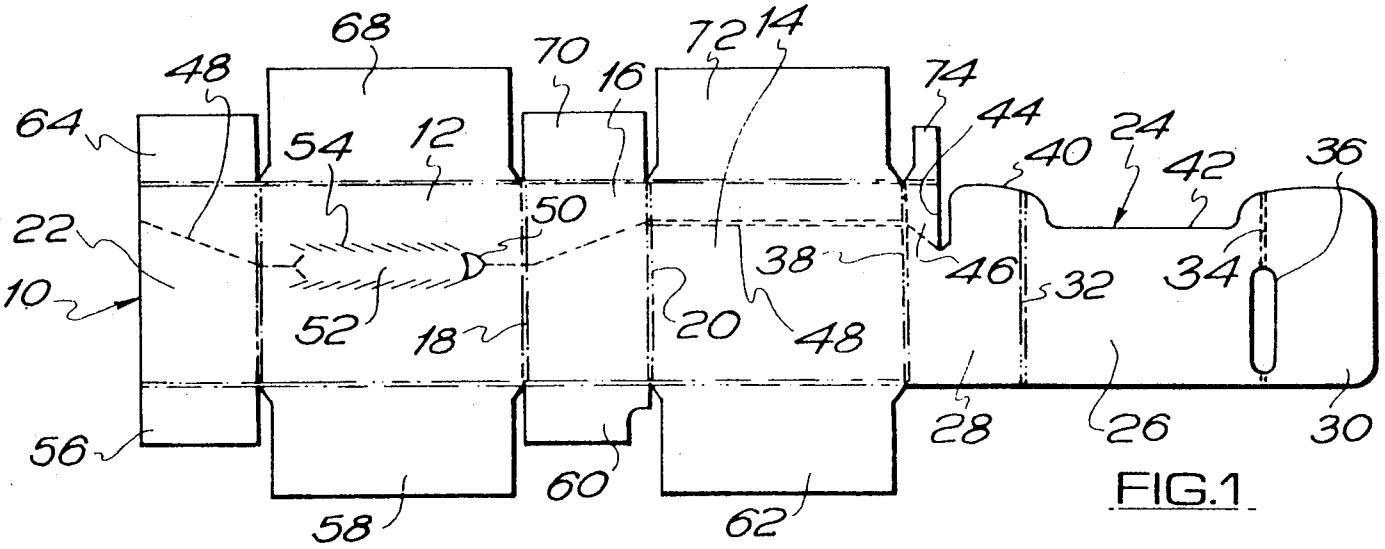
FIG. 1 is a plan view of the blank erectible into the container according to the embodiment of the invention.

Referring to the drawings, a blank 10 of cardboard material is cut and creased to the form shown. The crease lines are shown as double dotted lines, whilst the cut lines are shown in single full lines.

The blank comprises two main outer panels 12 and 14 which are respectively front and rear walls of an outer casing of the finished container, and panels 12 and 14 are of identical size and are connected by a first side panel 16 by fold lines 18, 20 and a second side panel 22 is connected to the opposite edge of panel 12.

To the opposite edge of panel 14 from panel 16 is connected a section 24 of the blank which folds to form an inner lining for the finished container. Section 24 is made up of a main and front panel 26 and side panels 28 and 30 which are connected to panel 26 by fold lines 32 and 34. In fold line 34 is provided a cut out 36 of the form shown. Section 24 is connected to panel 14 by a fold line 38.

The section 24 is profiled at the upper edge 40 to the configuration shown, so as to define a recess 42 in the panel 26, and a wide slot 44 in the top of the panel 28 leaving a portion 46 defined by a perforated line 48 which passes from the end of slot 44 across panel 14 through panel 16, and leads to a finger aperture 50 in panel 12. The finger aperture in panel 12 is at the end of a tear strip 52 defined by slits 54 in the panel 12, and the tear line 48 then continues from the end of the tear strip 52 along panel 12 and across panel 22. Where the line 48 crosses panels 22 and 16, it is inclined so as to define an appropriate flip top lid as will be explained hereinafter.

Hinged to the lower sides of the panels 22, 12, 16 and 14 are base flaps 56, 58, 60 and 62, and top flaps 64, 68, 70 and 72 are hinged to the opposite and top edges of the side panels 22, 12, 16 and 14. The section 46 also has hinged thereto an extension panel 74.

Figure 2:
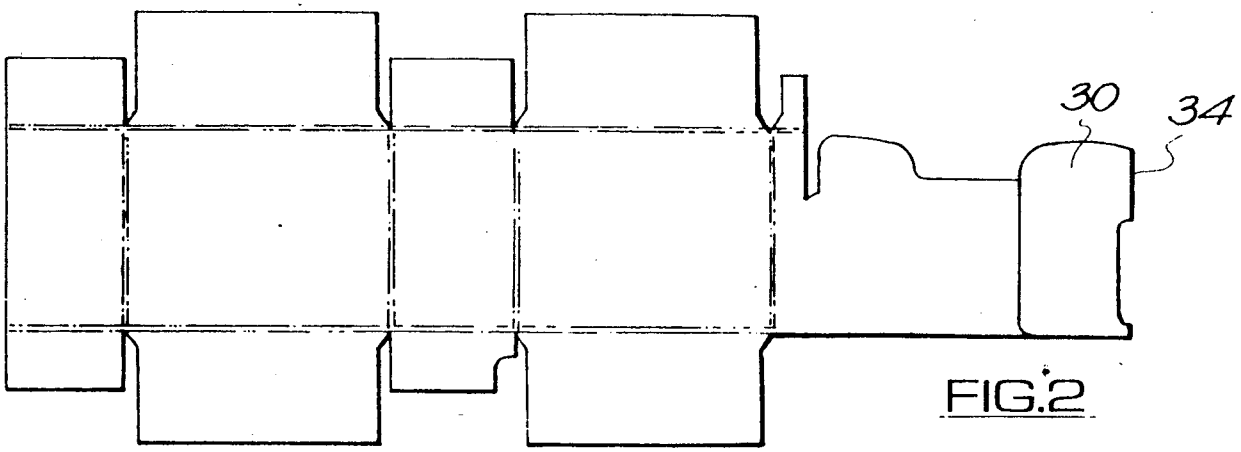
FIGS. 2, 3 and 4 show the blank in various stages of folding to produce the container according to the invention.
Figure 3:
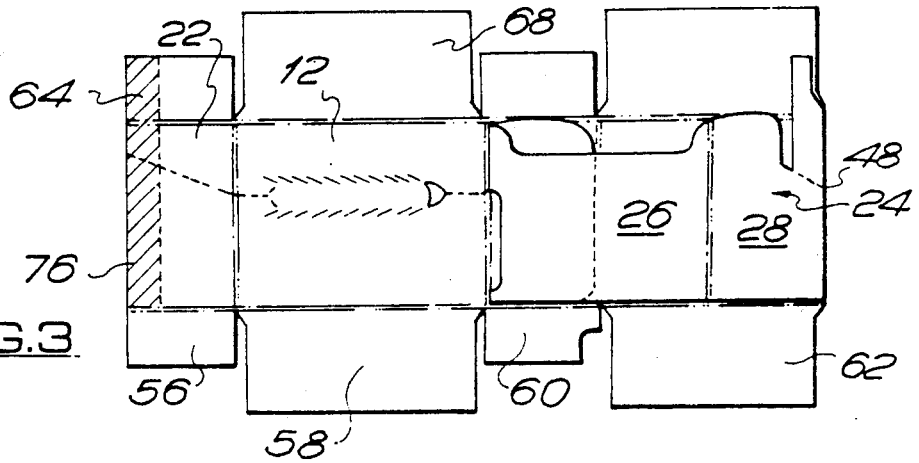
Figure 4:
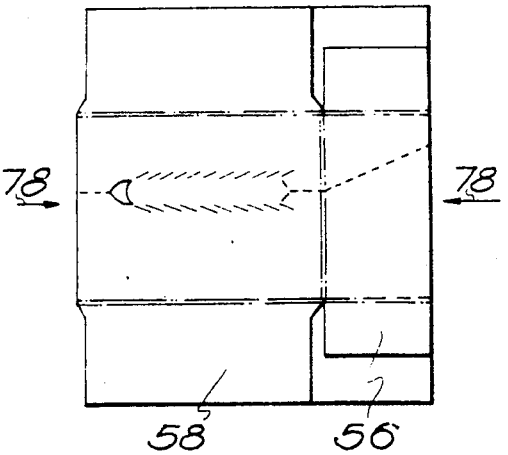

In order to erect the blank shown in FIG. 1, panel 30 initially is folded about fold line 34 to the position shown in FIG. 2. In the second stage of erection, the section 24 is folded about fold line 38 to the position shown in FIG. 3 so that panel 30 overlies panel 16 as shown in FIG. 3 and finally panels 12 and 22 are folded about fold line 18 to the position shown in FIG. 4, so that the panel 12 overlies panel 26 and panel 22 overlies panel 28. The shaded area 76 as shown in FIG. 3 is glued to the edge of panel 28 which the shaded area overlies so that in fact as shown in FIG. 4 a lay flat sleeve is formed which can be erected by pushing the edges of the sleeve together as indicated by reference 78 in FIG. 4.

Figure 5:
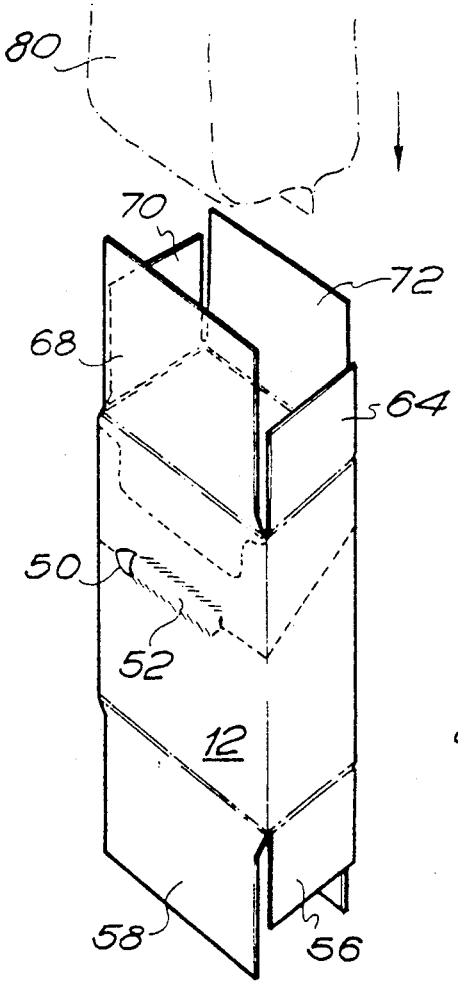
FIG. 5 is a perspective view of the partially erected container.

The resulting erected sleeve is shown in FIG. 5.

To close the container, initially the panels 56, 58, 60 and 62 are inwardly folded and glued together to form the base of the container and then the contents, indicated by reference 80 are placed inside the container thus far erected and the container finally is closed by folding the flaps 64, 68, 70 and 72 inwardly and gluing same together.

Figure 6:
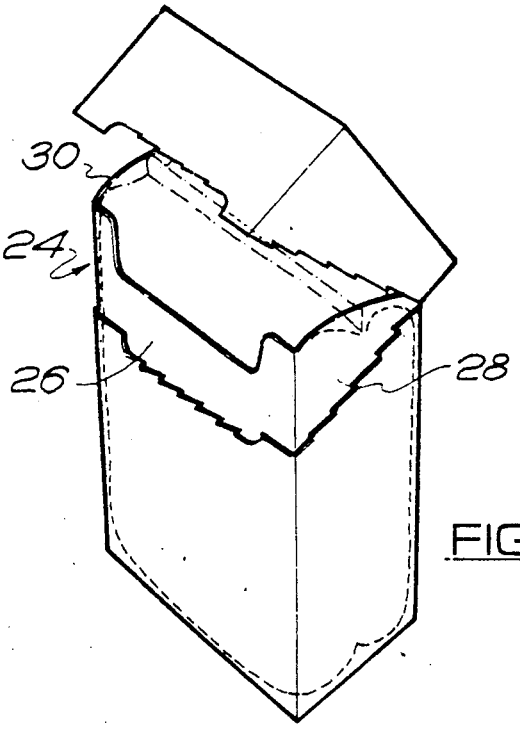
FIG. 6 is a perspective view of the fully erected container after the flip top lid has been opened.

It is to be noticed that the contents 80 comprise tea bags contained in a sealed sleeve of the nature described in our co-pending patent application Ser. No. 8914372.1, and to gain access to the contents, the user inserts his finger in the aperture 50 and grips the end of the tear strip 52 tearing same from the front panel 12 so that, as shown in FIG. 6, the lid made up of the top of the container and those portions of the panels 46, 14, 16, 12 and 64 above the tear line 48, can be hinged as shown in FIG. 6. In this connection, it is noted that the tear line 48 where it exists in panel 14 is in fact a fold line which forms a hinge for the lid.

The section 24 is shown clearly in FIG. 6 by virtue of its panels 26, 28 and 30 forms an inner sleeve or casing for the container contents.

An effective and simple container construction results for the effective holding of sealed packages of tea bags or the like.

The applicant reserves the right to claim any feature or combination of features of the described embodiment which comprises or is shown to constitute a novelty.

I claim:

1. A container formed from cut and creased sheet material and having contents, the sheet material being cut and creased to form a blank which can be folded into the container which is rectilinear and has a flip-top lid which is initially opened by tearing the container along predetermined lines of weakening so that the lid can be hinged relative to the remainder of the container, to gain access to the contents, and wherein part of the blank forms an inner lining, and wherein the container comprises an outer case having walls with inner surfaces and the inner lining comprises three panel sections which lie respectively on the inner surfaces of three walls of the outer case of the container, and wherein the outer case comprises a front wall, a rear wall, two side walls, a base and a top, the top and sections of the front, rear and side walls defining the lid, and wherein there is a tear strip section in the front wall providing a finger grip to enable a section to be removed by tearing to facilitate the opening of the lid relative to the remainder of the container.

2. A container according to claim 1, wherein the base is defined by fold over flaps which are glued together in the erection of the container.

3. A container according to claim 1 or 2, wherein the top is defined by a fold over flap.

4. A container according to claim 1 wherein, in the erection of the blank to form the container, the inner panels and outer panels are folded and gluing is effected to connect same whilst the blank is in the form of a lay flat sleeve and following the movement of the sleeve to erected condition, the base is formed by folding and gluing base flaps, after which the container contents are inserted and finally the top is closed by folding and gluing of top flaps.

5. A container according to claim 1, wherein the contents comprise tea bags held in one or more hermetically sealed sleeves.

6. A blank erectible into a container according to claim 1.

* * * * *

UNITED STATES PATENT AND TRADEMARK OFFICE

CERTIFICATE OF CORRECTION

PATENT NO. : 5,036,982

DATED : AUGUST 6, 1991

INVENTOR(S) : STEPHEN ASTON

It is certified that error appears in the above-identified patent and that said Letters Patent is hereby corrected as shown below:

On the title page: Item [54] and Column 1, line 1,

DELETE THE WORDS "RELATING TO". TITLE OF THE INVENTION SHOULD

THEREFORE READ:

PACKAGING CONTAINERS

Signed and Sealed this

Twenty-sixth Day of October, 1993

*Attest:*

*Attesting Officer*

Bruce Lehman

BRUCE LEHMAN

*Commissioner of Patents and Trademarks*